United States Patent [19]

Okabe et al.

[11] Patent Number: 4,662,325

[45] Date of Patent: May 5, 1987

[54] SELF-CONTAINED HYDRAULIC VALVE LIFTER

[75] Inventors: Yoshio Okabe, Chiryu; Eiji Shirai, Okazaki, both of Japan

[73] Assignee: Aisin Seiki Kabushiki Kaisha, Kariya, Japan

[21] Appl. No.: 756,647

[22] Filed: Jul. 19, 1985

[30] Foreign Application Priority Data

Jul. 25, 1984 [JP] Japan ..... 59-155946

[51] Int. Cl.[4] ..... F01L 1/24

[52] U.S. Cl. ..... 123/90.58; 123/90.55

[58] Field of Search ..... 123/90.55, 90.58, 90.59, 123/90.46, 90.57

[56] References Cited

U.S. PATENT DOCUMENTS

| | | | |
|---|---|---|---|
| 2,109,815 | 3/1938 | Best | 123/90.58 |
| 2,833,257 | 5/1958 | Lengnick | 123/90.58 |
| 3,495,577 | 2/1970 | Collins | 123/90.58 |
| 4,402,285 | 9/1983 | Arai et al. | 123/90.58 |

FOREIGN PATENT DOCUMENTS

| | | | |
|---|---|---|---|
| 2911550 | 9/1979 | Fed. Rep. of Germany | 123/90.55 |
| 2814185 | 10/1979 | Fed. Rep. of Germany | 123/90.55 |
| 125305 | 9/1960 | Japan | 123/90.55 |
| 3339773 | 6/1984 | Japan | 123/90.55 |

*Primary Examiner*—Ira S. Lazarus

*Attorney, Agent, or Firm*—Oblon, Fisher, Spivak, McClelland & Maier

[57] ABSTRACT

A self-container hydraulic valve lifter includes a lifter body slidably mounted in a lifter case, a free piston slidably mounted between the lifter body and the lifter case, a plunger slidably mounted in the lifter body and dividing an interior portion of the lifter body into a reservoir chamber and a pressure chamber, a check valve for allowing fluid flow from the reservoir chamber to the pressure chamber, and an operating chamber formed between the free piston and the lifter case and communicated with the reservoir chamber in order to decrease the diameter of the pressure chamber in comparison with that of the free piston.

3 Claims, 2 Drawing Figures

SELF-CONTAINED HYDRAULIC VALVE LIFTER

BACKGROUND OF THE INVENTION

1. Field of the Invention

This invention relates to hydraulic valve lifters as used in the valve trains of internal combustion engines and, more particularly to hydraulic valve lifters of the self-contained type in which a fluid is sealed within the assembly without provision for its replacement from any external source during operation.

2. Discussion of the Background

In a conventional self-containing hydraulic valve lifter such as shown in FIG. 2, the self-containing valve lifter 50 comprises a lifter body 51 and a plunger 52 slidably mounted in the body 51. A seat member 53 fixed to an upper opening portion of the body 51 engages with a push rod seat (not shown). A lower end of the body 51 engages with a cam (not shown). A fluid pressure chamber 54 is formed between the body 51 and a bottom wall of the plunger 52 and reservoir chamber 55 is formed within the plunger 55.

A check valve in the form of ball 57 is disposed in the pressure chamber 54 to close an aperture 56 formed in the bottom wall of plunger 52. The check valve 57 permits one-way fluid flow only from the reservoir chamber 55 to the pressure chamber 54.

A free piston 58 is slidably mounted in the plunger 52. The piston 58 is biased downwardly by a spring 59 and acts to absorb the changing quantity of fluid in the reservoir chamber 55. The plunger 52 is biased upwardly by a spring 60 disposed in the pressure chamber 54.

In this conventional valve lifter 50, due to the structure allowing the free piston 58 to be slidably mounted in the plunger 52, the diameter of pressure chamber 54 is set to be larger than that of the free piston 58. Therefore, when the valve lifter 50 is pressed downwardly in passing through a complete stroke thereof from the free condition in response to the rotation of the cam, the vertical stroke of the free piston 58 is larger than that of the complete stroke of the valve lifter 50. As a result, the total inner length 1 of the plunger 52 accommodating the free piston 52 is required to be longer. Therefore, the total length of the valve lifter 50 is increased and installation of the valve lifter 50 is more difficult.

SUMMARY OF THE INVENTION

It is therefore an object of the present invention to avoid the disadvantages of the prior art self-contained hydraulic valve lifter noted above.

More particularly, it is an object of the present invention to provide an improved self-containing hydraulic valve lifter wherein the total length of valve lifter is decreased.

It is another object of the present invention to provide an improved self-containing hydraulic valve lifter which is simple in construction and is inexpensive.

These and other objects are achieved or facilitated in accordance with the present invention by providing a new and improved self-contained hydraulic valve lifter which includes a lifter body slidably mounted in a lifter case, a free piston slidably mounted in an annular space provided between the lifter body and the lifter case, a plunger slidably mounted in the lifter body and dividing a reservoir chamber and a fluid pressure chamber within the lifter body, a one-way check valve permitting fluid flow only from the reservoir chamber to the pressure chamber, and an operating chamber defined between the free piston and the lifter case and communicating with the reservoir chamber.

Accordingly, the diameter of free piston is set so as to be larger than that of the pressure chamber. Therefore, when the valve lifter is pressed downwardly during the complete stroke thereof from the free condition in response to rotation of cam, the vertical stroke of the free piston is smaller as compared with the complete stroke of valve lifter. Consequently, the total inner length of the lifter case accommodating the free piston can be decreased, and therefore, the total length of the valve lifter can be decreased.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
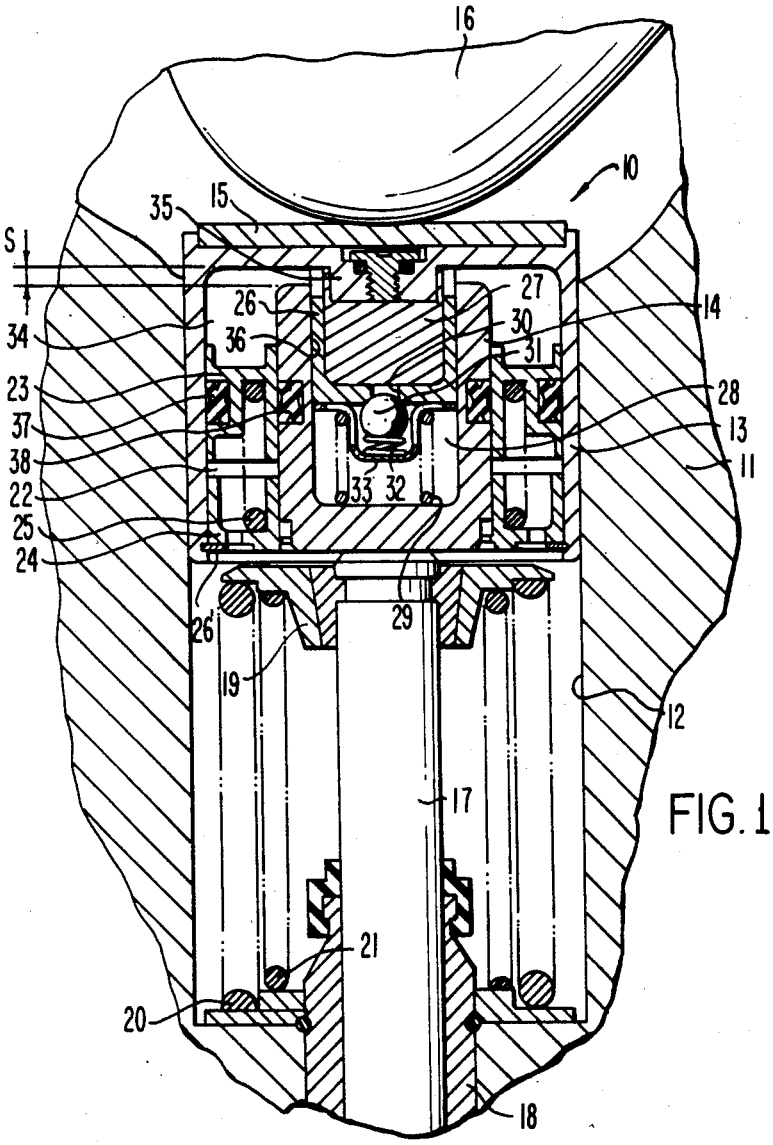
FIG. 1 is a partial enlarged sectional view of a self-contained hydraulic valve lifter constructed in accordance with the present invention.
Figure 2:
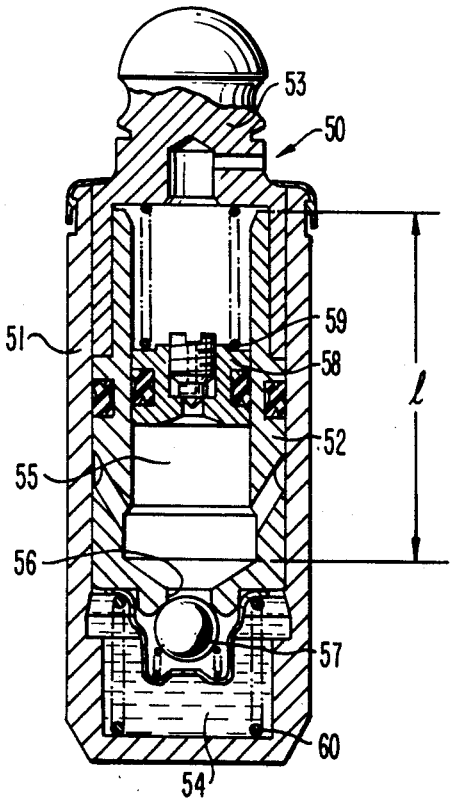
FIG. 2 PRIOR ART
FIG. 2 is a sectional view of a conventional self-contained hydraulic valve lifter.

Referring now to the drawings, there is illustrated in FIG. 1 a self-contained hydraulic valve lifter which can be installed in any direction, even vertically or horizontally, in a bore 12 which in turn is provided in a cylinder head of an internal combustion engine. Namely, a lifter case 13 is mounted in the bore 12 and a lifter body 14 is slidably mounted in the center portion of an internal space portion of lifter case 13. A cover plate 15 is fixed to the upper portion of the lifter case 13 and is engaged with a cam 16 while an engine valve 17 is connected with the lower portion of the lifter body. The engine valve 17 is slidably mounted in a valve guiding member 18 fixed to a cylinder head of the internal combustion engine and is biased upwardly by springs 20 and 21 via a retainer 19. Thus, the engine valve 17 is biased in a direction for contacting a valve seat (not shown).

A free piston 23 is slidably mounted in an annular space formed between an inner wall of the lifter case 13 and an outer wall of the lifter body 14 and is biased upwardly by a return spring 25 disposed between a spring holder 24 and the free piston 23. The spring holder 24 is limited with respect to downward movement thereof by a ring 26' engaged with an annular groove formed in an inner surface of the lifter case 13.

A plunger 26 is slidably mounted in the lifter body 14 and the internal space of the lifter body 14 is divided into a reservoir chamber 27 and a fluid pressure chamber 28.

The plunger 26 is biased upwardly by a return spring 29 disposed within the pressure chamber 28. A check valve in the form of a ball 31 is disposed in the pressure chamber 28 to close an aperture 30 provided in the bottom wall of the plunger 26. The ball 31 is biased by a spring 32 which is located within a cup-shaped retainer 33. The force of the spring 32 is smaller than that of the return spring 29. The check valve 31 permits fluid flow only from the reservoir chamber 27 to the pressure chamber 28. An operating chamber 34 formed between the free piston 23 and the upper wall of the lifter case 13 continuously communicates with the reservoir chamber 27 via a passage 35 provided in the upper portion of the plunger 26.

When the fluid pressure within the pressure chamber 28 increases, the fluid flows into the reservoir chamber 27 from the pressure chamber 28 via an annular leakage clearance 36 provided between the inner surface of the lifter body 14 and the outer surface of the plunger 26. Reference numerals 37 and 38 indicate sealing rings of elastic material.

When the engine is started, the cam 16 rotates and the lobe of the cam moves downwardly, the lifter body 14 is moved upwardly by the engine valve 17 which is biased upwardly by the springs 20 and 21. Namely, the lifter body 14 moves in the direction decreasing the complete stroke S which exists at the top surface of the lifter body 14 and the upper wall of the lifter case 13. As a result, due to an increase in the fluid pressure within the pressure chamber 28, the fluid flows into the reservoir chamber 27 from the pressure chamber 28 via the leakage clearance 36. Simultaneously, in order to absorb the increasing amount of fluid within the reservoir chamber 27, the free piston 23 moves downwardly against the biasing force of spring 25. As a result, the operating chamber 34 in communication with the reservoir chamber 27 expands and the quantity of fluid within the operating chamber 34 increases. Namely, when the valve lifter is pressed downwardly for a complete stroke S from its free condition in response to the rotation of the cam 16, the vertical stroke of the free piston 23 is shorter than the complete stroke S of lifter body 14 due to the diameter of free pistion 23 being set so as to be larger than that of pressure chamber 28. The free piston is provided between the lifter case 13 and the lifter body 14 and the pressure chamber 28 is defined by the lifter body 14 and plunger 26.

Next, in response to further rotation of the cam 16, the lifter body 14 moves downwardly and the pressure chamber 28 is expanded. The fluid pressure within the pressure 28 is decreased whereby the check valve 31 is shifted to an open condtion and the fluid flows into the pressure chamber 28 from the reservoir chamber 27 via check valve 31 in order to compensate for the fluid pressure within the pressure chamber 28. Simultaneously, the free piston moves upwardly via return spring 25 in order to adsorb the decreased fluid in the reservoir chamber 27 whereby the volume of the operating chamber 34 communicated with the reservoir chamber 27 and the quantity of fluid within the operating chamber 34 decreases.

As described in the above operation, the valve lifter 10 repeats the reciprocating movement in response to the rotation of the cam 16 during the driving of the engine.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A self-contained hydraulic valve lifter, comprising:

a lifter case having an internal space;

a lifter body slidably mounted in said internal space of said lifter case;

a free piston slidably mounted in an annular space provided between said lifter body and said lifter case;

a plunger slidably mounted in said lifter body and dividing an interior portion of said lifter body into a reservoir chamber and a fluid pressure chamber;

a check valve for allowing fluid flow from said reservoir chamber to said pressure chamber;

an operating chamber formed between said free piston and said lifter case and communicated with said reservoir chamber;

a spring positioned between said lifter case and said lifter body wherein said free piston is biased in a direction decreasing the volume of said operating chamber by said spring;

a first sealing member installed in an outer circumferential surface of said free piston; and a second sealing member installed in an outer circumferential surface of said lifter body.

2. A self-contained hydraulic valve lifter according to claim 1, further comprising means formed between said lifter body and said plunger for communicating said reservoir chamber and said pressure chamber.

3. A self-contained hydraulic valve lifter according to claim 1, wherein said check valve is disposed within said pressure chamber.

* * * * *